US006998774B1

(12) United States Patent
Barnardo et al.

(10) Patent No.: US 6,998,774 B1
(45) Date of Patent: Feb. 14, 2006

(54) ELECTRICALLY INSULATED ELECTROLUMINESCENT DISPLAY

(75) Inventors: Christopher John Andrew Barnardo, Bishops Stortford (GB); Christopher James Newton Fryer, Cottenham (GB)

(73) Assignee: Cambridge Consultants Limited, Cambridge (GB)

( * ) Notice: Subject to any disclaimer, the term of this patent is extended or adjusted under 35 U.S.C. 154(b) by 0 days.

(21) Appl. No.: 10/019,991

(22) PCT Filed: May 22, 2000

(86) PCT No.: PCT/EP00/04652

§ 371 (c)(1),
(2), (4) Date: May 27, 2003

(87) PCT Pub. No.: WO00/72638

PCT Pub. Date: Nov. 30, 2000

(30) Foreign Application Priority Data

May 20, 1999 (GB) ..... 9911789

(51) Int. Cl.
*H05B 33/26* (2006.01)
*H05B 33/06* (2006.01)

(52) U.S. Cl. ..... 313/509; 313/506; 313/510; 313/513; 315/169.3

(58) Field of Classification Search ..... 313/502–512, 313/513; 315/169.3; 362/105, 106
See application file for complete search history.

(56) References Cited

U.S. PATENT DOCUMENTS

| | | | | |
|---|---|---|---|---|
| 3,573,532 A * | 4/1971 | Boucher | 313/509 |
| 4,999,936 A * | 3/1991 | Calamia et al. | 40/544 |
| 5,686,792 A * | 11/1997 | Ensign, Jr. | 313/509 |
| 5,747,363 A * | 5/1998 | Wei et al. | 438/5 |
| 6,116,745 A * | 9/2000 | Yei | 362/105 |
| 6,465,951 B1 * | 10/2002 | Krafcik et al. | 313/512 |

* cited by examiner

*Primary Examiner*—Karabi Guharay
*Assistant Examiner*—Sikha Roy
(74) *Attorney, Agent, or Firm*—Alix, Yale & Ristas, LLP

(57) ABSTRACT

An electroluminescent display has a transparent front-electrode, rear electrodes, and a layer of electroluminescent material located between the first and second electrodes. Conductive tracks are electrically connected to the rear electrodes and supply a driving voltage for the electroluminescent material to the rear electrodes. A backplane layer is provided between the electroluminescent material layer and the conductive tracks, and is electrically connected to the front electrode such that the potential difference across the electroluminescent material layer in the region of the conductive tracks is substantially zero. In this way, when the conductive track is supplying the driving voltage to the rear-electrodes, the electroluminescent material layer is not illuminated by an electric field between the conductive tracks and the front electrode. Gaps may be defined in the front electrode corresponding substantially to the location of the conductive tracks. This also prevents the voltage in the conductive tracks from illuminating the electroluminescent material layer. An addressable electroluminescent display may be included in an item of clothing.

19 Claims, 4 Drawing Sheets

ELECTRICALLY INSULATED ELECTROLUMINESCENT DISPLAY

BACKGROUND OF THE INVENTION

The present invention relates to electroluminescent displays.

Electroluminescence is the emission of light by a material when subjected to an electric field. Phosphor electroluminescence was discovered and documented in 1936. However, it was only in the 1950's that GEC and Sylvania received patents for electroluminescent powder lamps. The short lifetime, for example 500 hours, of such devices limited their usefulness.

Work carried out in the 1980's revitalised the powder electroluminescent lamp, and in 1990 the Durel Corporation demonstrated a flexible electroluminescent phosphor device that was incorporated as a backlight into a liquid crystal flat panel display. The manufacturing technique involved encapsulating the phosphor powder particles in glass beads and sandwiching the encapsulated powder between two electrodes, to which an AC voltage was applied to stimulate emission. Electroluminescent devices made according to this type of method are known as "thick film" or "powder" electroluminescent devices. This is to be contrasted with "thin film" electroluminescent devices, in the manufacture of which a thin layer of electroluminescent phosphor is deposited on a, typically glass, substrate by a method such as atomic layer epitaxy.

Traditionally, thin film technology has been used to make electroluminescent displays, and thick film technology has been used to make electroluminescent lamps, in particular backlights for liquid crystal displays (LCDs). An example of a thin film device is described in U.S. Pat. No. 5,463,279, and an example of a thick film device is described in U.S. Pat. No. 5,686,792.

A typical thick film phosphor electroluminescent device comprises a layer of electroluminescent material in a dielectric matrix, sandwiched between two planar conducting electrodes. The electroluminescent material comprises phosphor particles, typically a zinc sulphide (ZnS) powder doped with manganese (Mn), microencapsulated in a dielectric material. Typically, silver- or graphite-loaded screen-printable inks, and indium tin oxide (ITO), a transparent conductive material, respectively are used to form the electrodes on a substrate such as a polyester film. When an AC voltage is applied between the electrodes, the electroluminescent material emits light.

The inventors have recently developed thick film electroluminescent displays in which a plurality of shaped independent electrodes are provided on at least one side of a layer of shaped or unshaped electroluminescent material. A voltage may be applied selectively to each of these independent electrodes to illuminate a respective region of the display. A thick film electroluminescent display is created by selecting the configuration of the independent electrodes to represent information, for example in the form of a seven-segment display or the like.

Thus, the inventors have recently developed an addressable electroluminescent display, i.e. an electroluminescent display comprising a plurality of display areas each having the shape of a graphical element wherein each display area may be separately, selectively illuminated.

A problem associated with the manufacture of thick film electroluminescent displays is that the independent electrodes must be connected electrically to a voltage source for the display. In a convenient manufacturing technique, electrical connections are applied as conductive tracks on the rear surface of the device, for example by screen printing conductive ink. However, the tracks themselves can act as electrodes and cause the electroluminescent phosphor to emit light where the phosphor is sandwiched between a transparent front electrode and the conductive track. Thus, the conductive tracks appear as illuminated lines on the display and adversely affect the clarity of the displayed information, which is undesirable.

U.S. Pat. No. 5,686,792 relates to an electroluminescent lamp with a continuous electroluminescent dielectric layer and a patterned rear electrode overlying the electroluminescent dielectric layer. The rear electrode includes at least two conductive segments separated by a gap. An insulating layer fills the gap and a conductive interconnect overlies the insulating layer, joining the segments. The insulating layer spaces the interconnect from the electroluminescent dielectric layer a sufficient distance to reduce the electric field in the electroluminescent dielectric layer below the point at which the lamp appears luminous.

The solution to the problem of visible electrical interconnections in the context of an electroluminescent lamp provided by U.S. Pat. No. 5,686,792 has certain disadvantages. For example, the depth of the insulating layer is fixed by the manufacturing process and this depth determines a maximum voltage which can be applied to the rear electrode without causing illumination of the electrical connections in the electroluminescent display. Furthermore, the thickness of the insulating layer must be carefully controlled to ensure the invisibility of the interconnections, and this places additional constraints on the manufacturing process. Also the thickness and inflexibility of the insulating layer adds to the overall thickness of the display and detracts from its flexibility.

SUMMARY OF THE INVENTION

The present invention seeks to provide a novel configuration of an electroluminescent display in which the electrical connections to the electrodes of the display are not visible as illuminated regions of the electroluminescent material.

Viewed from a first aspect therefore the invention provides an addressable electroluminescent display comprising:

- a first layer comprising an electrically-conductive, transparent, front-electrode;
  - a second layer comprising a plurality of electrically-conductive, rear-electrode segments;
  - a third layer located between the first and second layers and comprising electroluminescent material;
  - a fourth layer comprising a plurality of electrically-conductive tracks each of which is electrically connected at a first end to at least one of the rear-electrode segments;
  - a fifth layer located between the fourth layer and a sixth layer (defined below), comprising dielectric material and following substantially the path of the electrically-conductive tracks; and
  - a sixth layer located between the third and the fifth layers, comprising an electrically-conductive, backplane which:
  - is electrically connected to the front-electrode in front of the backplane such that the potential difference across the third layer in the region of the sixth layer is substantially zero;
  - follows substantially the path of the electrically-conducting tracks;

wherein, in use, a driving voltage for driving the illumination of an area of the display is supplied across the first layer and a rear electrode segment in the second layer.

Thus according to the invention, in the region of the electrically-conductive tracks (or "electrical conductor"), the electrically conductive backplane (or "sixth layer" or "electrically conductive layer") ensures that there is substantially no potential difference across the electroluminescent material layer (or "third layer"), even if the electrically-conductive tracks are supplying driving voltage, and the electrically-conductive tracks therefore do not cause the electroluminescent material to illuminate.

The first layer (or "first, transparent electrode") may comprise a layer of a transparent conductive material, for example indium tin oxide, applied to a transparent substrate, for example a polyester film. The transparent conductive material may be applied to the transparent substrate by any suitable method, for example screen printing, sputtering and the like.

The configuration of the display is such that information can be represented by the display by the application of a voltage to selected rear-electrode segments (or "second electrodes"). For example the areas that can illuminate ("display areas") may be arranged in a numeric or alphanumeric display arrangement, such as a seven, fourteen or sixteen segment display.

The rear-electrode segments may be provided on the display by any suitable method, such as by screen printing with conductive, for example silver- or graphite-loaded, inks.

The electroluminescent material in the third layer (or "layer of electroluminescent material") is a thick film phosphor layer, for example zinc sulphide powder doped with manganese and microencapsulated in a dielectric material.

The electrically-conductive tracks may be formed on the device by any suitable method, such as by screen printing with conductive, for example silver- or graphite-loaded, inks. Feasibly, some electrically-conductive tracks may be formed on the device together with the rear-electrode segments. In this case, these electrically-conductive tracks may be considered as an extension of the relevant rear-electrode segments. At least part of the electrically-conductive tracks may be integral with the rear-electrode segments.

In general, a respective electrically-conductive track is provided for each rear-electrode segment.

The sixth layer (or "electrically conductive layer") may be arranged in substantially the same plane as the second layer. Thus, for example, the rear-electrode segments may be provided in one or more voids or recesses defined in the sixth layer. In this case, the spacing between the sixth layer and the rear-electrode segments, defined by the size of the voids, should be selected to prevent arcing due to potential differences between the sixth layer and the second layer.

A layer of dielectric material (or "fifth layer" or "first dielectric layer") is provided to insulate electrically the electrically-conductive tracks from the sixth layer, as there may be a significant potential difference between these components. Thus, such a dielectric layer must have sufficient electrical insulation capability to withstand the driving voltage for the electroluminescent material. This dielectric layer may be applied by any suitable method, such as screen printing.

In a preferred arrangement, the sixth layer is provided over the second layer. This arrangement has the advantage that the registration of the sixth layer relative to the second layer does not need to be as accurate to ensure correct electrical functioning of the device as when the rear-electrode segments are provided in voids or recesses in the sixth layer.

A further dielectric layer (or "second dielectric layer") may be provided to electrically insulate the second layer from the sixth layer, which will generally be at different potentials in use of the device. Such a dielectric layer may be applied by any suitable method, for example screen printing.

It is advantageous for any voids which exist in the sixth layer and any dielectric layers (for the purpose of allowing the electrically-conductive tracks to connect to the rear-electrode segments) to be made as large as possible in order to minimise the effect of any mis-registration of the sixth layer (and/or the associated dielectric layer(s)), the rear-electrode segments and the electrically-conductive tracks.

The sixth layer follows substantially the path of the electrically-conductive tracks, in order to reduce the cost of materials and to reduce registration problems associated with other methods. It is desirable for the fifth layer to cover a greater area than the sixth layer, so that electrical insulation is generally assured even in the case of variations in the registration of these layers. Likewise, it is desirable for the sixth layer to cover a greater area than the electrically-conductive tracks, so that the electrically-conductive tracks are generally not visibly illuminated even in the case of variations in the registration of the sixth layer relative to the electrically-conductive tracks.

Preferably, the sixth layer and the associated dielectric layer(s) overlap the area of the rear-electrode segments in order to allow for tolerances in the registration of the sixth layer and the associated dielectric layer(s) relative to the electrically-conductive tracks.

Preferably, the overall area of the sixth layer and the associated dielectric layer(s) is maintained as small as possible to minimise the probability of a short circuit due to imperfections, such as pin holes, in the dielectric layer(s).

The sixth layer may comprise a plurality of separate portions, each electrically connected to the relevant part of the first layer. In other words, the backplane may comprise a plurality of electrically conductive backplane track elements 7 as shown in FIG. 3. Each of the backplane track elements 7 is associated with one or more of the electrically-conductive tracks 9, has substantially the same two-dimensional form as, but is wider than, its associated electrically-conductive track and stops short of its associated electrically conductive track 9. FIG. 3 also illustrates an electroluminescent display in which the fifth layer comprises a plurality of dielectric tracks each of which is associated with one of the electrically-conductive tracks and each of which dielectric tracks has substantially the same two-dimensional form as, but is wider than its associated electrically-conductive track and, at a first end, stops short of the first end of its associated electrically-conductive track.

FIG. 3 illustrates an addressable electroluminescent display in which backplane track-elements 7 are provided substantially exclusively in areas of the display in which there exists electroluminescent material and a front electrode and an electrically-conductive track 9. FIG. 3 further illustrates an addressable electroluminescent display in which the backplane track-elements 7 are provided substantially exclusively outside of display areas at which the second layer is shaped in the form of the graphical element.

FIG. 4 illustrates a further embodiment of an electroluminescent display including a plurality of electrically conductive, transparent front electrodes 1*a*, 2*a*, 1*b*, 2*b*. In the embodiment of FIG. 4, the electroluminescent material is also configured as a plurality of separate electroluminescent material segments 3*a*, 3*b*.

A void (or gap) may be provided in the first layer opposite an electrically-conductive track, so that an electric field is not generated between the first layer and the electrically-conductive track, which would cause the electroluminescent material to illuminate in the region of the electrically-conductive track. The void(s) may be defined in the first layer by etching or otherwise ablating (e.g. using lasers) the transparent conductive material from the transparent substrate. Alternatively, the transparent conductive material may be applied to a transparent substrate in a configuration which defines the void(s).

According to the invention, electroluminescent devices may be made which are flexible, lightweight and relatively inexpensive. Advantageously, an electroluminescent display may be incorporated into an item of clothing.

Thus, viewed from a second aspect the invention provides an item of clothing comprising an addressable electroluminescent display with a plurality of display areas each having the shape of a graphical element and each of which may be separately, selectively illuminated.

The electroluminescent display may be arranged to display information relating to the wearer of the clothing. For example, the display may represent an amount of oxygen which remains in the tanks of breathing apparatus used by a fire-fighter or a diver. Similarly, the display could represent the elapsed time from the start of a race for a particular athlete.

The electroluminescent display may include additional electronics for controlling the display. For example, the display may include short-range communication electronics for example utilising the DECT or Blue Tooth communications protocols.

Advantageously, the electroluminescent display may comprise an electroluminescent device according to the first aspect of the invention.

Although the invention has been described in terms of the structure of an electroluminescent display, the invention also extends to a method of making such a display as described herein.

Viewed from a yet further aspect, the invention provides an electroluminescent display comprising:

a first, transparent electrode;

at least one second electrode;

a layer of electroluminescent material located between the first and second electrodes;

an electrical conductor in the form of a conductive track, electrically connected to the second electrode and arranged to supply, in use, a driving voltage for the electroluminescent material to the second electrode;

an electrically conductive layer which is provided between the electroluminescent material layer and the electrical conductor, substantially following the path of the electrical conductor, said conductive layer being electrically connected to the first electrode, such that the potential difference across the electroluminescent material layer in the region of the electrical conductor is substantially zero; and a first dielectric layer located between the electrical conductor and the conductive layer.

BRIEF DESCRIPTION OF THE DRAWINGS

Some embodiments of the invention will now be described by way of example only, and with reference to the accompanying drawings, in which.

DETAILED DESCRIPTION OF THE PREFERRED EMBODIMENTS

Figure 1:
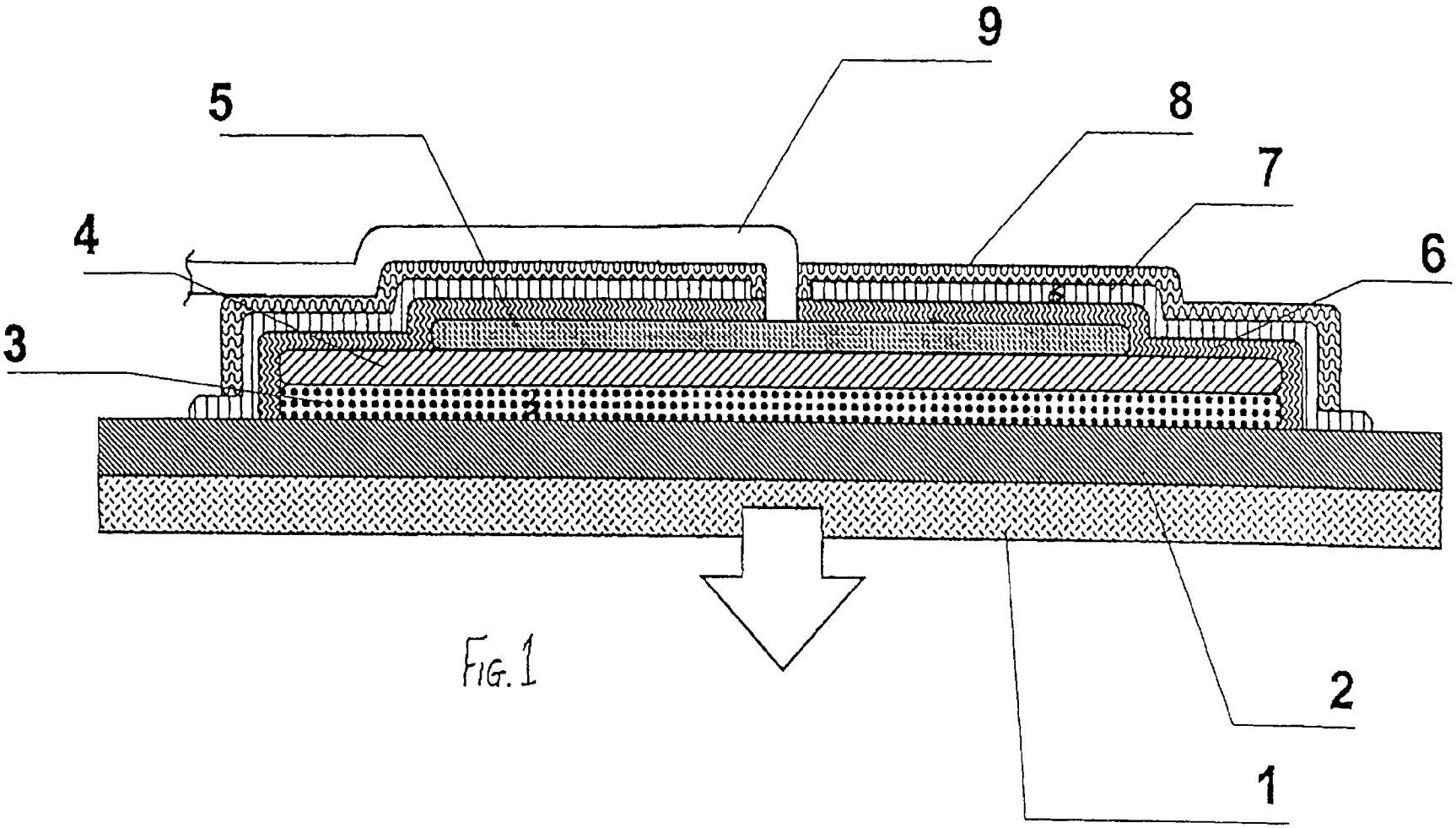
FIG. 1 is a schematic representation of an electroluminescent display showing some aspects of the invention.

As shown in FIG. 1 an electroluminescent display according to the invention comprises a substrate layer 1 of transparent polyester, which is prefabricated with a layer of indium tin oxide (ITO) 2 to form a transparent front-electrode. A layer of thick film electroluminescent phosphor material 3 is provided on top of the ITO layer 2. A first dielectric layer 4 is provided over the phosphor layer 3, and on top of the first dielectric layer 4 is provided a rear-electrode 5 of screen-printed silver-loaded ink. The rear-electrode 5 is covered by a second dielectric layer 6. The second dielectric layer 6 electrically isolates the rear-electrode 5 from a backplane layer 7, also of screen-printed silver-loaded ink. On top of the backplane layer 7 is provided a third dielectric layer 8, which electrically isolates the backplane layer 7 from an electrically-conductive track 9.

The electrically-conductive track 9 thus runs in a longitudinal direction between a point at one end of the track where it is connected to a rear-electrode segment and a point at another end of the track where it is connected either directly or indirectly to a voltage supply. The direction of "width" (as used herein) of the electrically-conductive track and of other tracks associated with the electrically-conductive track is defined as that direction which is substantially perpendicular to the longitudinal direction of the electrically-conductive track.

As shown in FIG. 1, the backplane layer 7 is electrically connected to the ITO layer 2 so that these two layers are always at the same electrical potential.

In use, an AC driving voltage of 100 to 600 volts is applied between a rear-electrode segment 5 (via the conductive track 9) and the ITO layer 2, in order to generate an electric field across the electroluminescent phosphor 3 so that the phosphor emits light.

The conductive backplane layer 7 is always at substantially the same electrical potential as the ITO layer 2, and is located between the phosphor layer 3 and the conductive track 9. There is therefore no electric field across the electroluminescent phosphor layer 3 due to the driving voltage in the conductive track 9. In effect, the backplane layer 7 shields the electroluminescent phosphor layer 3 from the driving voltage in the conductive track 9, so that the phosphor layer 3 is not illuminated by the conductive track 9.

Figure 2:
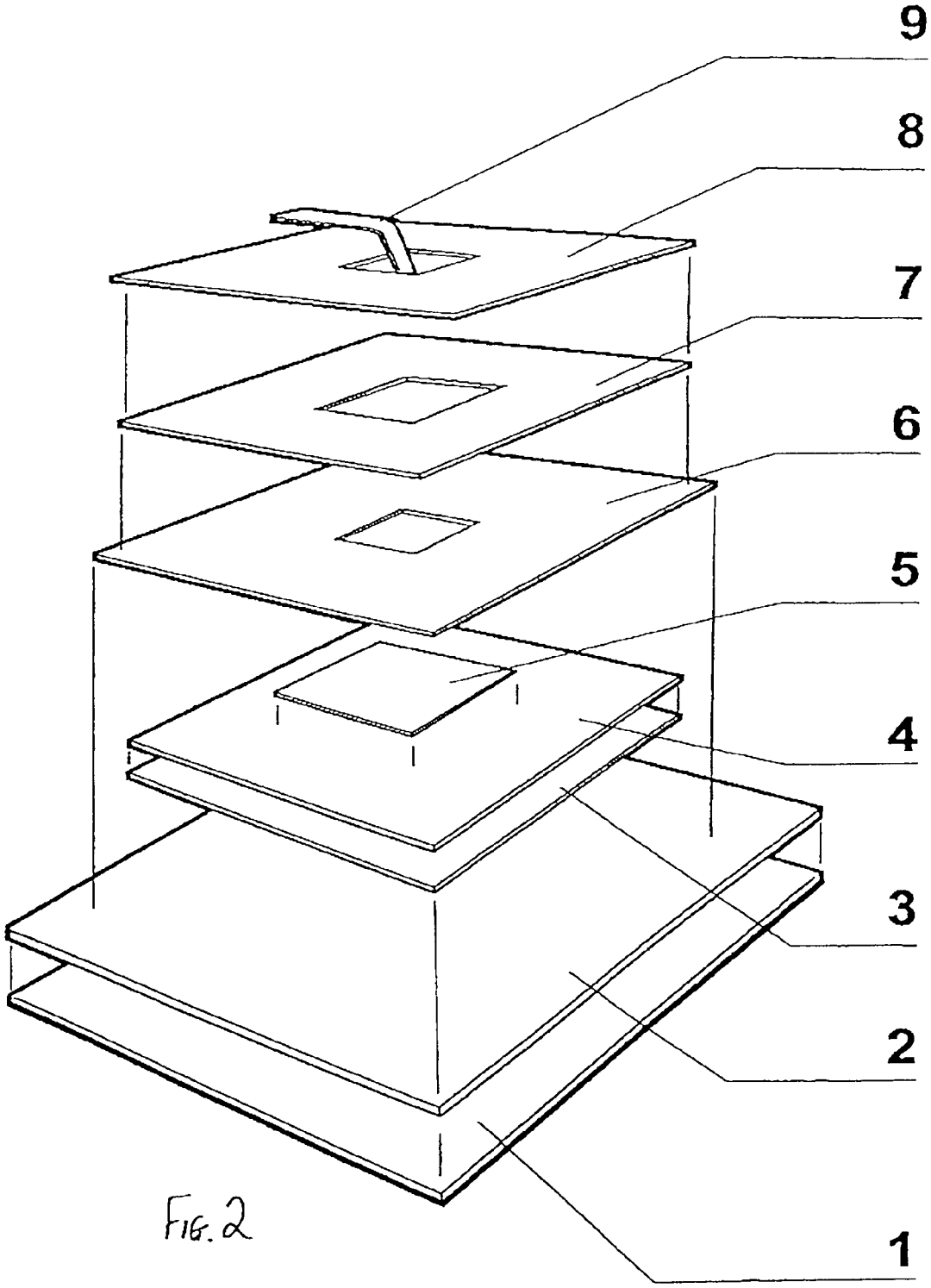
FIG. 2 is an exploded view of the device of FIG. 1.
Figure 3:
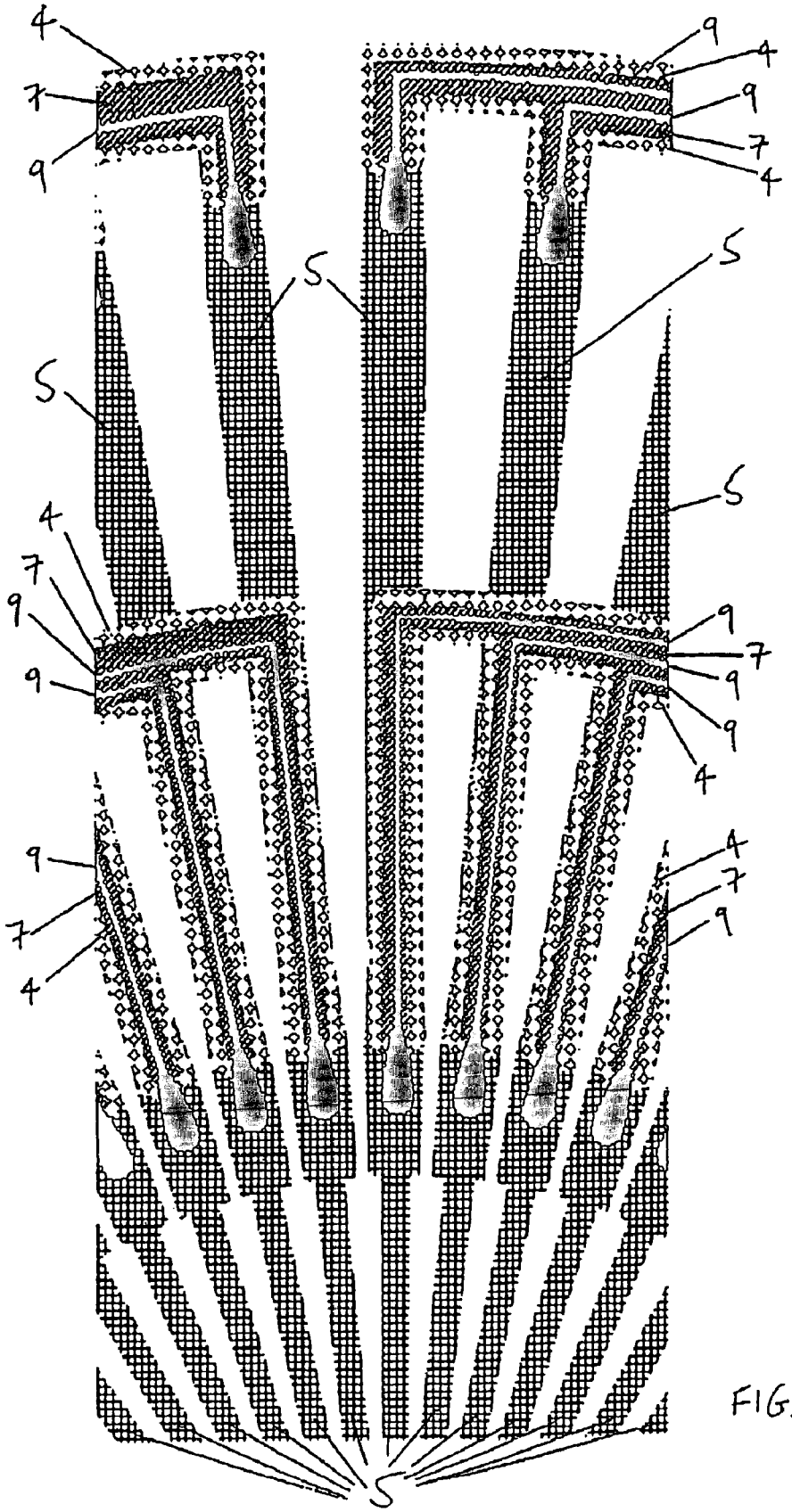
FIG. 3 is a schematic representation of an electroluminescent display showing aspects of the invention.
Figure 4:
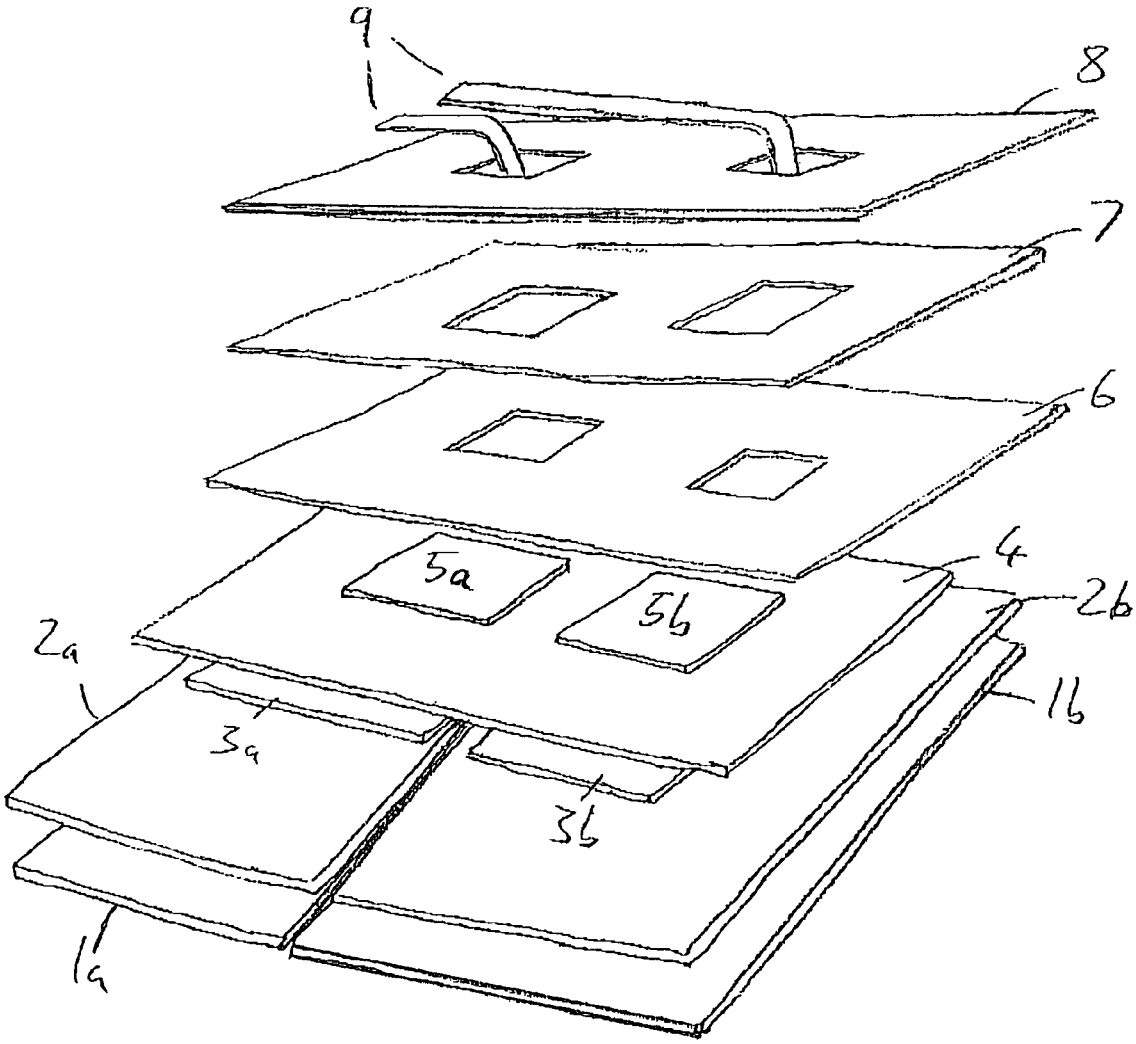
FIG. 4 is an exploded view of an alternative embodiment of an electroluminescent display illustrating aspects of the invention.

Although the third dielectric layer 8, the backplane layer 7, and the second dielectric layer 6, are represented in FIG. 2 as having voids defined therein for the conductive track 9, for a display according to the invention, the third dielectric layer 8, the backplane layer 7, and the second dielectric layer 6, in fact, follow substantially the path of the conductive track 9, in order to reduce the cost of materials and to prevent registration problems between these layers, as shown in FIG. 3.

FIG. 3 shows a plurality of rear electrodes 5 which are configured to form the hour, minute and second hands on the top part of an analogue clock display. Electrically-conductive tracks 9 are connected to these rear electrodes 5. The conductive tracks 9 sit on a second dielectric layer (not shown in FIG. 3) which in turn sits on a backplane layer 7 which in turn sits on a first dielectric layer 4.

In summary, an electroluminescent display comprises a transparent front-electrode 1,2, a rear-electrode 5, and a layer of electroluminescent material 3 located between the front and rear electrodes. A conductive track 9 is electrically connected to the rear-electrode 5 and supplies a driving voltage for the electroluminescent material 3 to the second electrode 5. A backplane layer 7 is provided between the electroluminescent material layer 3 and the conductive track 9, and is electrically connected to the front electrode 1,2, such that the potential difference across the electroluminescent material layer 3 in the region of the conductive track 9 is substantially zero. In this way, when the conductive track 9 is supplying the driving voltage to the rear electrode 5, the electroluminescent material layer 3 is not illuminated by an electric field between the conductive track 9 and the front electrode 1,2.

Note that although the description has mainly described embodiments in which the shape of illuminated areas are defined by the rear electrodes, this shape may alternatively be defined by appropriate shaping of the front electrode or the electroluminescent material layer or a combination of the front electrode, the electroluminescent material and the rear electrode.

It is also to be noted that, with suitable provision of driving voltages (that is, actively driving "on" displays areas to be illuminated and "off" display areas to not be illuminated), there is no need for a backplane layer to be provided in areas behind rear-electrode segments, since those rear-electrode segments which are driven "off " (i.e. set to the same voltage as the transparent, front-electrode) act in the same way that such a backplane layer would and ensure that electrically-conductive tracks which run behind them cannot cause any illumination of the electroluminescent material in front of them. It is further to be noted that there is also no need to provide a backplane layer in areas of the display where there is either no front-electrode or no electroluminescent material or no electrically-conductive track.

In an alternative arrangement (not shown), a gap is defined in the front electrode 1,2 corresponding substantially to the location of the conductive track 9. This also prevents the voltage in the conductive track 9 from illuminating the electroluminescent material layer 3.

An electroluminescent display may be included in an item of clothing.

It is possible to prevent the unwanted illumination of the electrical conductors without the use of a conductive layer as described above.

In this case, an electroluminescent device comprises:

a first, transparent electrode;

at least one second electrode;

a layer of electroluminescent material located between the first and second electrodes; and an electrical conductor electrically connected to the second electrode and arranged to supply, in use, a driving voltage for the electroluminescent material to the second electrode, wherein a void is defined in the first electrode corresponding substantially to the location of the electrical conductor.

Thus a void (or gap) is provided in the first electrode opposite the electrical conductor, so that an electric field is not generated between the first electrode and the electrical conductor, which would cause the electroluminescent material to illuminate in the region of the electrical conductor.

What is claimed is:

1. An addressable electroluminescent display comprising:

a first layer comprising an electrically-conductive, transparent, front-electrode;

a second layer comprising a plurality of electrically-conductive, rear-electrode segments;

a third layer located between the first and second layers and comprising electroluminescent material;

a fourth layer comprising an plurality of electrically-conductive tracks each of which is electrically connected at a first end to at least one of the rear-electrode segments;

a fifth layer located between the fourth layer and a sixth layer (defined below), comprising dielectric material and following substantially the path of the electrically-conductive tracks; and a sixth layer located between the third and the fifth layers, comprising an electrically conductive backplane which:

is electrically connected to the front-electrode in front of the backplane such that the potential difference across the third layer in the region of the sixth layer is substantially zero; and follows substantially the path of the electrically-conductive tracks;

wherein, in use, a driving voltage for driving the illumination of an area of the display is supplied across the first layer and a rear electrode segment in the second layer.

2. An addressable electroluminescent display according to claim 1, comprising a plurality of display areas each having the shape of a graphical element and each of which may be separately, selectively illuminated, wherein, at each display area, at least one of the first, second or third layers is shaped in the form of the graphical element.

3. An addressable electroluminescent display according to claim 2, wherein the backplane of the sixth layer comprises a plurality of electrically-conductive, backplane track-elements.

4. An addressable electroluminescent display according to claim 3, wherein each of the backplane track-elements:

is associated with one of the electrically-conductive tracks;

has substantially the same two-dimensional form as, but is wider than, its associated electrically-conductive track; and stops short of the first end of its associated electrically-conductive track.

5. An addressable electroluminescent display according to claim 4, wherein the fifth layer comprises a plurality of dielectric tracks each of which is associated with one of the electrically-conductive tracks and each of which dielectric tracks has substantially the same two-dimensional form as, but is wider than its associated electrically-conductive track and, at a first end, stops short of the first end of its associated electrically-conductive track and wherein the backplane of the sixth layer comprises a plurality of electrically-conductive, backplane track-elements, wherein each of the backplane track-elements stops short of the first end of the associated dielectric track.

6. An addressable electroluminescent display according to claim 3, wherein backplane track-elements are provided substantially exclusively in areas of the display in which there exists electroluminescent material and a front electrode and an electrically-conductive track.

7. An addressable electroluminescent display according to claim 3, wherein backplane track-elements are provided substantially exclusively outside of display areas at which the second layer is shaped in the form of the graphical element.

8. An addressable electroluminescent display according to claim 1, wherein the first layer comprises a plurality of separate electrically-conductive, transparent, front-electrode segments.

9. An addressable electroluminescent display according to claim 1, wherein the third layer comprises a plurality of electroluminescent material segments.

10. An addressable electroluminescent display according to claim 1, wherein the fifth layer comprises a plurality of dielectric tracks each of which is associated with one of the electrically-conductive tracks and each of which dielectric tracks has substantially the same two-dimensional form as, but is wider than its associated electrically-conductive track and, at a first end, stops short of the first end of its associated electrically-conductive track.

11. An addressable electroluminescent display according to claim 1, further comprising a dielectric layer located between the second layer and the third layer.

12. An addressable electroluminescent display according to claim 11, wherein the dielectric layer substantially follows the path of the electrically-conductive tracks.

13. An addressable electroluminescent display according to claim 1, wherein at least one of the second layer, the fourth layer and the sixth layer is formed as a conductive track on a printed circuit board.

14. An addressable electroluminescent display according to claim 1, wherein the second layer, the fourth layer, the fifth layer and the sixth layer are formed as the layers of a multi-layer printed circuit board.

15. An electroluminescent display comprising;

a first, transparent electrode;

at least one second electrode;

a layer of electroluminescent material located between the first and second electrodes;

an electrical conductor in the form of a conductive track, electrically connected to the second electrode and arranged to supply, in use, a driving voltage for the electroluminescent material to the second electrode;

an electrically conductive layer which is provided between the electroluminescent material layer and the electrical conductor, substantially following the path of the electrical conductor, said conductive layer being electrically connected to the first electrode, such that the potential difference across the electroluminescent material layer in the region of the electrical conductor is substantially zero; and a first dielectric layer located between the electrical conductor and the conductive layer.

16. A device as claimed in claim 15, further comprising a second dielectric layer located between the second electrode and the conductive layer, wherein the conductive layer and the first and second dielectric layers overlap the area of the second electrode.

17. A device as claimed in claim 15, wherein at least one of the second electrode, the conductive layer and the electrical conductor is formed as a conductive track on a printed circuit board.

18. An item of clothing comprising an electroluminescent display, wherein the electroluminescent display comprises an electroluminescent device as claimed in claim 15.

19. An item of clothing comprising an addressable electroluminescent display with a plurality of display areas each having the shape of a graphical element and each of which may be separately, selectively illuminated, wherein the addressable electroluminescent display comprises:

a first layer comprising an electrically-conductive, transparent, front-electrode;

a second layer comprising a plurality of electrically-conductive, rear-electrode segments;

a third layer located between the first and second layers and comprising electroluminescent material;

a fourth layer comprising a plurality of electrically-conductive tracks each of which is electrically connected at a first end to at least one of the rear-electrode segments;

a fifth layer located between the fourth layer and a sixth layer, comprising dielectric material and following substantially the path of the electrically-conductive tracks; and a sixth layer located between the third and the fifth layers, comprising an electrically-conductive, backplane which is electrically connected to the front-electrode in front of the backplane such that the potential difference across the third layer in the region of the sixth layer is substantially zero and follows substantially the path of the electrically-conductive tracks;

wherein, in use, a driving voltage for driving the illumination of an area of the display is supplied across the first layer and a rear electrode segment in the second layer.

* * * * *